US005386272A

United States Patent [19]

Nakazato

[11] Patent Number: 5,386,272

[45] Date of Patent: Jan. 31, 1995

[54] APPARATUS AND METHOD FOR PROTECTING FIXING UNIT IN IMAGE FORMING SYSTEM AGAINST DAMAGE

[75] Inventor: Yasushi Nakazato, Tokyo, Japan

[73] Assignee: Ricoh Company, Ltd., Tokyo, Japan

[21] Appl. No.: 763,930

[22] Filed: Sep. 23, 1991

[30] Foreign Application Priority Data

Sep. 28, 1990 [JP] Japan ..... 2-257025

[51] Int. Cl.[6] ..... G03G 21/00

[52] U.S. Cl. ..... 355/207; 219/216; 355/282

[58] Field of Search ..... 355/205, 209, 206, 207, 355/285, 282, 289, 313; 219/216, 469, 470, 471

[56] References Cited

U.S. PATENT DOCUMENTS

| | | | |
|---|---|---|---|
| 3,940,210 | 2/1976 | Donohue | 355/313 |
| 4,556,779 | 12/1985 | Hashimoto et al. | 219/216 |
| 4,627,714 | 12/1986 | Nozaki | 219/216 X |
| 4,745,430 | 5/1988 | Tsuchiya | 219/216 X |
| 4,994,852 | 2/1991 | Matsuuchi et al. | 355/206 |
| 5,023,631 | 6/1991 | Negishi et al. | 355/206 X |
| 5,032,874 | 7/1991 | Matsuuchi | 355/285 |

FOREIGN PATENT DOCUMENTS

| | | | |
|---|---|---|---|
| 0370520 | 5/1990 | European Pat. Off. . | |
| 2635019 | 8/1975 | Germany . | |
| 3802728 | 8/1988 | Germany . | |
| 3915024 | 11/1989 | Germany . | |
| 0146467 | 11/1980 | Japan . | |
| 0011152 | 3/1981 | Japan . | |
| 57-171366 | 10/1982 | Japan . | |
| 0055504 | 12/1983 | Japan . | |
| 0176076 | 9/1985 | Japan . | |
| 60-176076 | 9/1985 | Japan . | |
| 63-88570 | 4/1988 | Japan | 355/282 |

*Primary Examiner*—Matthew S. Smith
*Assistant Examiner*—Shuk Y. Lee
*Attorney, Agent, or Firm*—Cooper & Dunham

[57] ABSTRACT

A fixing unit protection apparatus and method for protecting a fixing unit in an image forming system against damage. The apparatus includes a first detection part for detecting a fixing temperature of a fixing roller in the fixing unit at which toner is fixed on a copy sheet, the fixing roller being heated by a heater provided within the fixing roller, and a fixing temperature control part for switching ON and OFF current applied to the heater in response to the fixing temperature, so as to prevent the fixing temperature from being an excessively high temperature. The apparatus also includes a signal generating part for generating a signal which serves to forcedly switch OFF the current applied to the heater for a short time periodically at a first time interval, a second detection part for detecting an ON state of the heater in which the current is continuously applied to the heater, and a current cutting part for cutting off the application of the current to the heater when the ON state of the heater continues for more than a second time interval which is longer than the first time interval.

22 Claims, 7 Drawing Sheets 9
31
35
R1
R2
C1
Sb
Sc
22
36
Sa
21
Vref
AN1
AN2
P1
GND
25
5
17
5a
5b
24
1
10
33
42
41
42c
Sg
40
R4
C3
Sf
39
Se
38
C2
R3
Sd
37
42a
42b
AC
32
23

APPARATUS AND METHOD FOR PROTECTING FIXING UNIT IN IMAGE FORMING SYSTEM AGAINST DAMAGE

BACKGROUND OF THE INVENTION

The present invention relates generally to a fixing unit protection apparatus, and more particularly to a fixing unit protection apparatus for protecting a fixing unit in an image forming system against damage, which is applicable to an image forming system including a laser printer, a photocopier, a facsimile or the like.

Generally, in an electrophotographic image forming system such as a laser printer, a fixing unit is provided for fixing a toner on a copy sheet, and the fixing unit includes a fixing roller and a pressure roller in pressure contact with the fixing roller, which are used for heating and pressing the copy sheet which is passed between the fixing roller and the pressure roller, whereby the toner becomes fused onto the copy sheet. A toner image is transferred from a surface of a photosensitive unit in the laser printer to the copy sheet, and the toner image is formed on the copy sheet by the fixing unit. The fixing roller in the fixing unit has a heater for heating the fixing roller so that the toner is fixed on the copy sheet, and a fixing temperature at which the fixing of the toner is performed by the fixing unit is controlled by a suitable means so that the fixing temperature is maintained at a constant level.

A description will now be given of a conventional fixing temperature control which is carried out by a conventional laser printer, with reference to FIGS. 1 to 3. FIG. 1 shows a structure of the conventional laser printer, and this laser printer generally has an exposure unit 1, a photosensitive drum 2, a developing unit 3, a cleaner 4, a fixing unit 5, paper feeders 6, paper cassettes 7, paper ejection trays 8, an engine board 9, and a power supply unit 10. Of these component parts, the fixing unit 5 includes a fixing roller 5*a* having a heater 5*b* for heating the fixing roller 5*a*. In the laser printer, a fixing temperature control circuit is provided for maintaining a fixing temperature at which the toner is fixed on the copy sheet at a constant level. This fixing temperature control circuit lies as shown in FIG. 2 extensively in the fixing unit 5, the engine board 9 and the power supply unit 10, and includes a thermistor 17 which is provided in the vicinity of a surface of the fixing roller 5*a* for detecting the fixing temperature at which the fixing is performed. This thermistor 17 forms a fixing temperature detection part of the fixing unit protection apparatus.

A fixing temperature control circuit which has widely been used for recent years employs a one-chip microcomputer 21 for controlling the fixing temperature in the fixing unit. This microcomputer 21 includes an internal analog-to-digital converter which is connected to input ports AN1, AN2 of the microcomputer chip. An analog signal indicative of a voltage at the thermistor 17 and an analog signal indicative of a reference voltage which is set by a variable resistor 25 are input to the input ports AN1, AN2 of the microcomputer 21, and these signals are converted into digital signals. The microcomputer 21 performs a signal comparison procedure, together with a drive element 22 in the engine board 9 and a solid-state relay (SSR) 21 in the power supply unit 10, so as to allow the digital signals from the A/D converter to accord with each other, whereby electrical power is supplied (in "ON" state) to the heater 5*b* for heating the fixing roller 5*a* or cut off (in "OFF" state) the electrical power on the basis of the result of the signal comparison procedure for digital signals.

The voltage at the thermistor 17 represents the fixing temperature in the fixing unit 5. If the thermistor voltage is lower than the reference voltage, then the microcomputer 21 changes a "heater ON" signal S*a* to "LOW" state and the heater 5*b* is switched ON and a heater current I flows across the heater 5*b*. If the thermistor voltage is higher than the reference voltage, then the "heater ON" signal S*a* is changed to "HIGH" state and the heater current I across the heater 5*b* is cut and the heater 5*b* is switched OFF.

In addition to the above mentioned fixing temperature control, the microcomputer 21 also carries out an image forming procedure of electrophotographic process parts including the exposure unit 1, and a sequence operation procedure of sequence operation parts including drive motors and clutches for driving and operating the photosensitive drum 2 and the paper feeders 6 and the like. The power supply unit 10 of the present example shown in FIG. 2 includes the SSR 23 only, but it also includes other power circuits.

FIG. 3A shows the fixing temperature changes at the heater 5*b* in the fixing temperature control circuit with respect to the elapsing time (in seconds) from a timing at which electrical power is started to be supplied to the heater 5*b* at a normal temperature. FIG. 3B shows a relationship between the "heater ON" signal S*a* and the heater current I with respect to the elapsing time (in seconds) from the same timing at which electrical power supply to the heater 5*b* is started. The "heater ON" signal S*a* is a signal instructing that the heater 5*b* be switched ON. When the "heater ON" signal is changed to "LOW" state and the heater 5*b* is at a normal temperature, the heater 5*b* is switched On, and immediately after that, the heater current I across the heater 5*b* is changed sharply and a rush current portion of the heater current I takes place as shown in FIG. 3B. For about 60 seconds until the fixing temperature indicated by a solid line in FIG. 3A is increased and reaches a high temperature within a standard temperature range in which the fixing unit can fix a toner on a copy sheet, the heater current I across the heater 5*b* is continuously maintained at a constant level, as shown in FIG. 3B. The fixing temperature is continuously within the standard temperature range by the heater 5*b* which is switched ON and OFF at 5 to 10 second cycles.

A rush current portion of the heater current I in the heater 5*b* in a cooled condition takes place because the internal resistance of the heater 5*b* at a relatively low temperature is sharply changed from that of the heater 5*b* at a normal temperature. The rush current across the heater 5*b* when the heater 5*b* in a cooled condition is switched ON is much greater than that when the heater 5*b* at a normal temperature is switched ON. Therefore, the change in the heater current when the heater 5*b* is switched ON at a room temperature is the greatest, and changes in the heater current when the heater 5*b* is switched ON and OFF after the fixing temperature has reached a high temperature within the standard temperature range does not exceed the former heater current change.

However, in a case in which a defective SSR 23 having a too small current resistance is connected in the power supply unit 10, a malfunction occurs in the power supply unit 10 owing to the flow of the above mentioned rush heater current across the SSR when the heater 5b at a normal temperature is switched ON. If the power supply unit 10 malfunctions, a problem arises in which the heater 5b is invariably in the ON state, regardless of the application of a "heater ON" signal to the heater 5b. The fixing temperature increasingly reaches a temperature at which the fuse 24 is subjected to fusion, as indicated by a dotted line in FIG. 3B. The fuse 24 is such a case is not preheated, and the fusion of the fuse 24 does not occur until a sufficient heat is transmitted from the heater 5b to the fuse 24. The conventional laser printer has a problem in that the fixing unit is seriously damaged until such a time period has passed before the fusion of the fuse 24. The same problem may arise in other cases in which a malfunction takes place at an output port of the microcomputer, at the heater drive element for generating a drive signal to the heater, and at the SSR drive circuit, or a short circuit occurs in a harness of the related circuit.

With respect to the above mentioned problems, it should be noted that the fixing unit which actually does not malfunction is subjected to a serious damage due to an erroneous malfunction discrimination. If a malfunction is erroneously located in the fixing unit of the laser printer, the fixing unit will incorrectly be replaced with a new fixing unit for the repair, and the new fixing unit is also damaged owing to the recurrence of the malfunction. The time and cost which has been spent for the repair and maintenance become greater and greater, causing a considerable damage to the user.

In order to eliminate the above described problems, Japanese Laid-Open Patent Application No. 52-89331 (which has been examined and published under Japanese Published Patent Application No. 56-11152), for example, discloses a malfunction detection method of detecting a malfunction in an image forming system, which is especially an overheating a fixing unit thereof. The fixing unit provided in the image forming system includes a fixing roller with a heater therein, and the heater is periodically switched ON and OFF at a temperature around a standard temperature of the fixing temperature. Time periods for which current is continuously applied to the heater of the fixing unit are each measured after the fixing temperature of a portion within the fixing unit increasingly has reached the standard temperature, the current applied to the heater being intermittently switched ON and OFF. When one of the measured time periods of continuous current application has reached a certain time period which is longer than an intended time period, it is determined that there is a malfunction in the application of current to the heater.

According to the malfunction detection method as disclosed in Japanese Laid-Open Patent Application No. 52-89331, the intended time period of continuous current application is preset to an appropriate value, and it is possible to make early detection of a malfunction in the laser printer so as to prevent the heater of the fixing roller from being overheated or damaged, and a countermeasure against the recurrence of the malfunction can be taken by the user in advance.

However, in a case of the actual image forming system, the time periods of the continuous current application are considerably varied when the fixing roller is driven, when the toner is fixed on the copy sheet, and when the temperatures of several portions in the image forming system become in equilibrium in the temperature distribution. It is impossible for the conventional malfunction detection method to detect a malfunction in the application of current for a time interval from when the application of current to the heater is started to when the fixing temperature increasingly reaches the standard temperature. Even if the malfunction detection time is limited to a time period after the fixing temperature has reached the standard temperature, it is very difficult to predetermine the intended time period of continuous current application which ensures not to cause an erroneous malfunction to be made and not to allow the fixing temperature to increase out of a permissible temperature range. In view of the ability to detect a malfunction in a laser printer, the laser printer with the malfunction detection capability which is produced according to with the conventional method will not be successful.

Japanese Laid-Open Patent Application No. 53-80239 (which has been examined and published under Japanese Published Patent Application No. 58-55504) discloses a malfunction detection apparatus. In this malfunction detection apparatus, the time periods of continuous current application to the heater of the fixing unit are checked in a similar manner, and when a malfunction has been detected, the current applied to the heater is forcedly cut off. However, this conventional malfunction detection apparatus has the same problem in that it cannot effectively detect a problem in the application of current to the heater, which is especially an overheat of the heater, for a time interval (a preheating period) from when the application of current is started to when the fixing temperature has increasingly reached the standard temperature.

Japanese Laid-Open Patent Application No. 55-146467 (which has been examined and published under Japanese Published Patent Application No. 62-4715) discloses a malfunction detection apparatus in which a malfunction detection in an image forming system is performed during the preheating period from when the application of current to the heater is started to when the fixing temperature has increasingly reached the standard temperature as a result of preheating the heater. In this conventional apparatus, when an overheating of the heater occurs, the current application to the heater is immediately cut off before a safety device such as a fuse, provided in the image forming system, is actually operated or fused. The malfunction detection time in this conventional apparatus is limited to the preheating period immediately after the current application to the heater is started, and it is possible to easily predetermine a timer operation time for practical use. However, the malfunction detection performed by this conventional apparatus can be effective only when the current application to the heater is started from a cooled condition of the fixing unit at ambient temperature. For example, in a case in which the power switch of the image forming system is turned OFF after the heater is preheated enough and then the power switch is again turned ON, the protection capability of this conventional apparatus to protect the fixing unit against damage is not adequate.

Furthermore, Japanese Laid-Open Patent Application No. 60-176076 discloses a malfunction detection apparatus for detecting a malfunction in a fixing unit for an electrophotographic copier. The malfunction detection apparatus, which is similar to that disclosed in Japanese Laid-Open Patent Application No. 53-80239, is constructed by making use of a firmware which has been developed and incorporated into a microcomputer. In this conventional malfunction detection apparatus, a signal indicative of whether or not there is a malfunction in the fixing unit is outputted and the signal is supplied to an indicating device for displaying a malfunction data thereon, thereby eliminating the need of a safety switching device such as a thermostat for detecting an overheating of the fixing unit.

However, this conventional apparatus includes no detection means for detecting current applied to the heater, and the case in which a fixing temperature control circuit invariably switched ON the application of current to the heater for more than a reference time period is not the only case in which the fixing unit is excessively overheated, and there are several other cases which are related primarily to a hardware problem. For example, when a malfunction occurs in a solid-state relay in the image forming system, when a short circuit takes place in a control line of the fixing temperature control circuit, or when the microcomputer crashes or becomes lost in a loop, the heater is actually overheated excessively. In such cases, the fixing unit protection capability of the conventional malfunction detection apparatus is not adequate.

As described above, the conventional malfunction detection apparatus detects a malfunction or overheating in the image forming system by checking the time for the fixing unit to reach the standard temperature during the preheating period, or the heater ON/OFF time intervals after the standard temperature is reached. When an overheating of the fixing unit is detected, the heater is already above the standard temperature and the fixing unit is highly overheated, thus it is not possible to prevent safely the fixing unit from being excessively overheated. Also, a reference time with which the time periods of continuous current application are compared for detecting an overheating of the heater must be predetermined experientially on the basis of the heater ON/OFF time periods which are actually measured, and there is a possibility that a malfunction is erroneously detected, owing to variations of the reference time in the volume production as well as environmental conditions at a place where the image forming system is located. In many cases, the image forming system including the conventional malfunction detection apparatus is not suitable for the manufacture thereof.

Once an overheating is erroneously detected by the conventional malfunction detection apparatus, a careful operation test must be performed repeatedly because the overheating of the heater cannot be neglected in view of the safety of the image forming system, and the users cannot place reliance on such a malfunction detection apparatus. In addition, even if an overheating is detected correctly, it is difficult for the conventional malfunction detection apparatus to determine where the malfunction occurs in the image forming system. In order to accurately locate the malfunction, the fixing unit, the fixing temperature control circuit, the power supply and the harnesses must be separately tested. If enough time and cost have not been spent for the tests for locating the malfunction, the above mentioned problem will arise which is, for example, a newly replaced fixing unit will be damaged due to the recurrence of the malfunction occurring in the fixing temperature control circuit. In such a case, the time and cost required for the recovery becomes greater unnecessarily. Especially in the case of the malfunction detection apparatus disclosed in Japanese Laid-Open Patent Application No. 60-176076, the occurrence of a malfunction of the fixing unit is displayed, but there is a problem in that the user cannot determine whether the malfunction takes place in the fixing unit or in the fixing temperature control circuit or elsewhere.

SUMMARY OF THE INVENTION

Accordingly, it is a general object of the present invention to provide an improved fixing unit protection apparatus in which the above described problems of the conventional apparatus are eliminated.

Another and more specific object of the present invention is to provide a fixing unit protection apparatus which detects accurately a malfunction in the image forming system and cuts off the current applied to the heater immediately when a malfunction occurs in the fixing temperature control circuit, thus preventing the fixing unit from being overheated.

Still another object of the present invention is to provide a fixing unit protection apparatus in which a microcomputer is used as part of the fixing temperature control circuit, the apparatus making possible to eliminate a problem that the heater is invariably switched ON when a malfunction or crash takes place in the microcomputer.

A further object of the present invention is to provide a fixing unit protection apparatus which makes possible to determine correctly that the malfunction occurs in the fixing temperature control circuit, not in the fixing unit itself, when the fixing unit protection apparatus is operated, thus allowing the user to perform a speedy recovery work.

The above mentioned objects of the present invention are achieved by a fixing unit protection apparatus which includes a first detection part for detecting a fixing temperature of a fixing roller in the fixing unit at which toner is fixed on a copy sheet, the fixing roller being heated by a heater provided within the fixing roller, a current control part for switching ON and OFF application of current to the heater in response to the fixing temperature detected by the first detection part, so as to prevent the fixing temperature of the fixing roller from becoming excessively high, a signal generating part for generating a signal which instructs the current control part to forcedly switch OFF the application of current to the heater for a short time at a predetermined first time interval, a second detection part for detecting an ON state of the heater in which the current is continuously applied to the heater, and detecting an OFF state of the heater in which no current is applied to the heater, and a current cutting part for cutting off the application of the current to the heater when the ON state of the heater detected by the second detection part continues for more than a second time interval which is longer than the predetermined first time interval. According to the present invention, it is possible to quickly detect a malfunction which occurs in the fixing temperature control circuit and it is also possible to cut off the application of current to the heater, thus preventing the fixing unit from being damaged unnecessarily. Also, the fixing unit protection apparatus according to the present invention can eliminate a problem of the conventional apparatus in which a malfunction is detected erroneously in the fixing unit and a newly exchanged fixing unit is damaged owing to the same malfunction, thus reducing the time for the recovery from the malfunction. The malfunction detection part of the present invention operates accurately and stably, and there is no stopping period for which the image forming system stops operation due to erroneous malfunction discrimination. Further, the present invention can provide a fixing unit protection apparatus having a simple construction with a low manufacturing cost, and it enables an extensive malfunction detection in the image forming system, the range of the image forming system for which several kinds of malfunctions can be detected including the fixing temperature control circuit (the microcomputer 21), the signals lines interconnecting the component parts, and the solid-state relay for switching on and off the application of current to the heater.

Other objects and further features of the present invention will become more apparent from the following detailed description when read in conjunction with the accompanying drawings.

DESCRIPTION OF THE PREFERRED EMBODIMENTS

Figure 1:
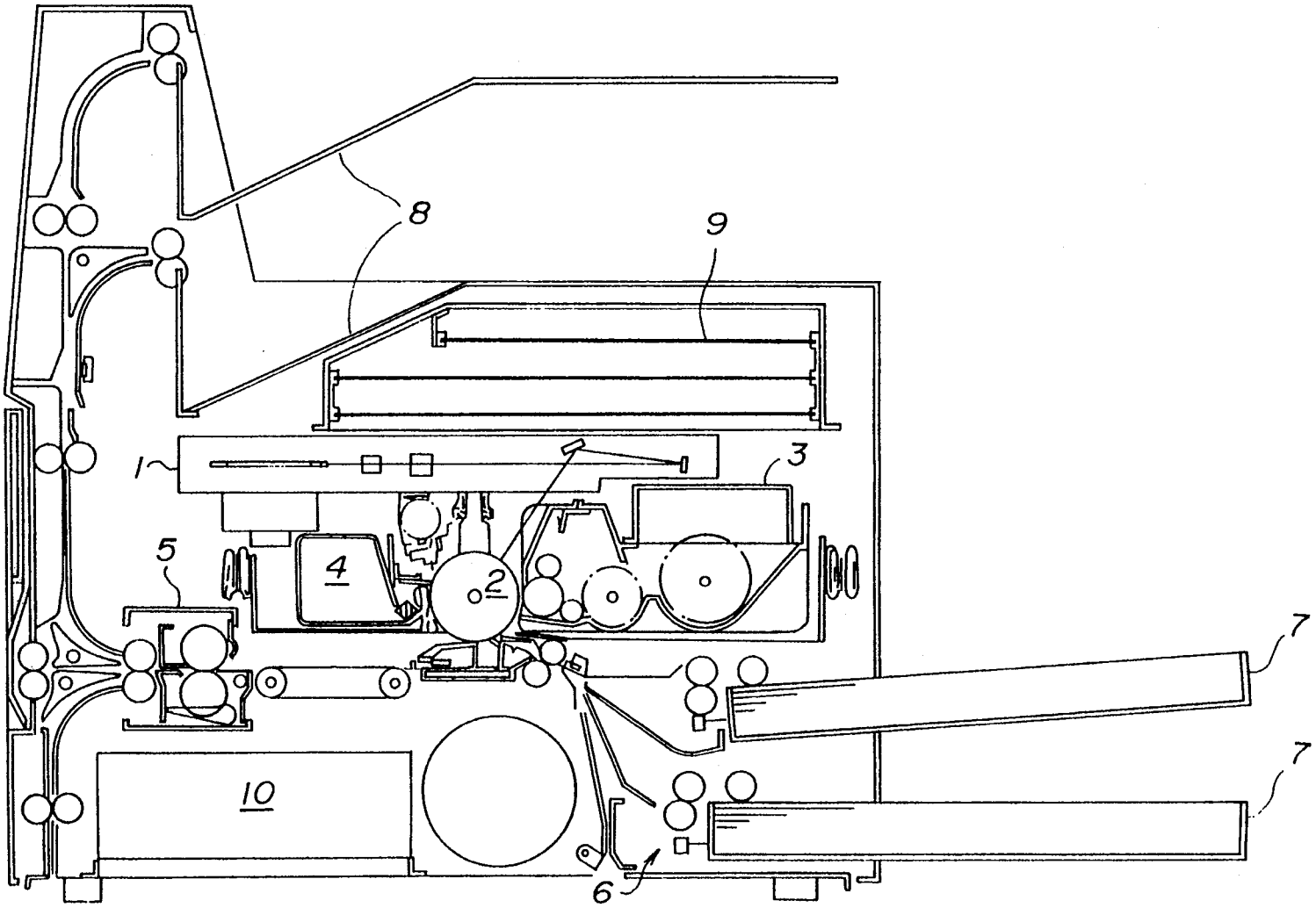
FIG. 1 PRIOR ART
FIG. 1 is a sectional view showing a conventional laser printer in which a fixing unit is provided.
Figure 2:
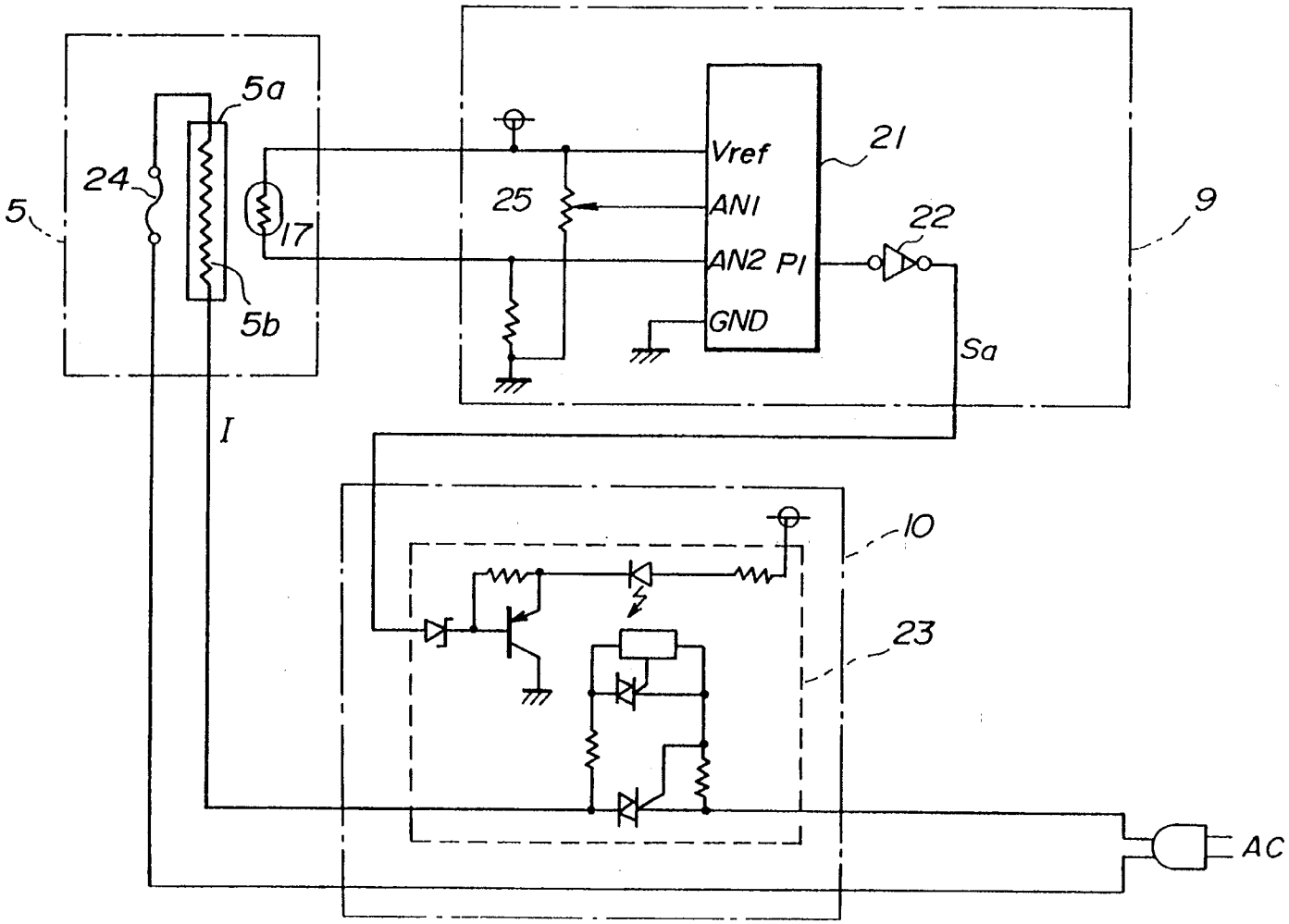
FIG. 2 PRIOR ART
FIG. 2 is a diagram showing a fixing temperature control circuit which is provided within the conventional laser printer in FIG. 1.
Figure 3A:
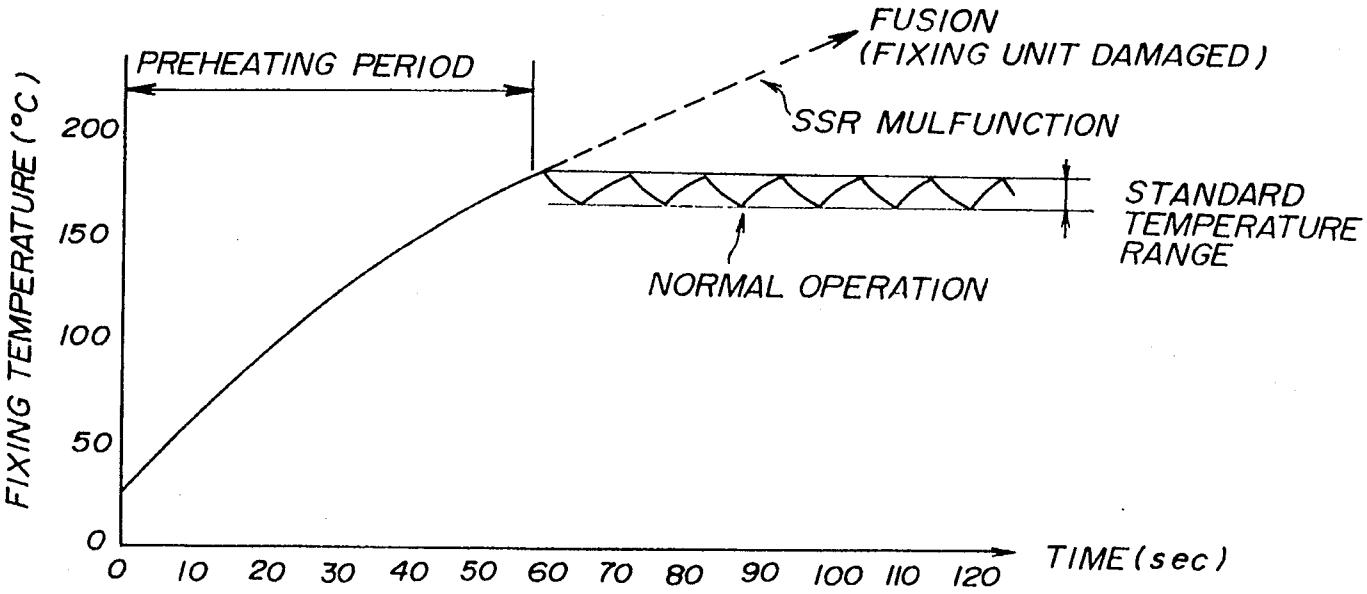
FIG. 3A PRIOR ART
FIGS. 3A and 3B are timing charts for explaining the operations of the fixing temperature control circuit shown in FIG. 2.
Figure 3B:
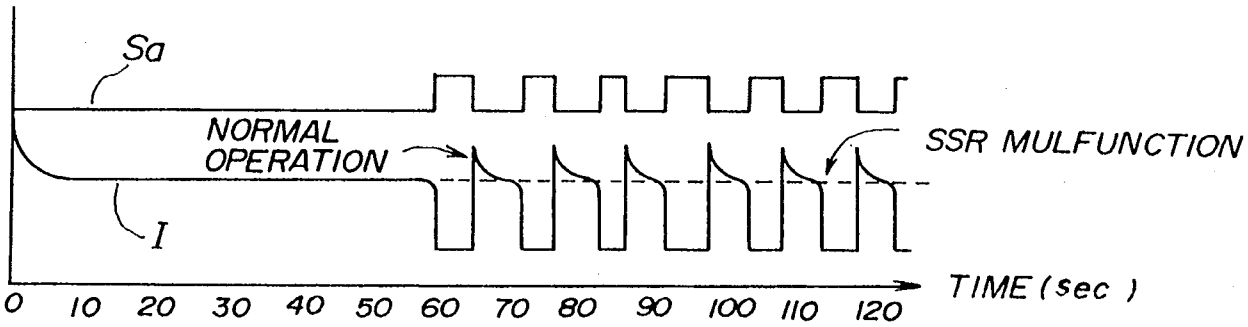
FIG. 3B PRIOR ART
Figure 4:
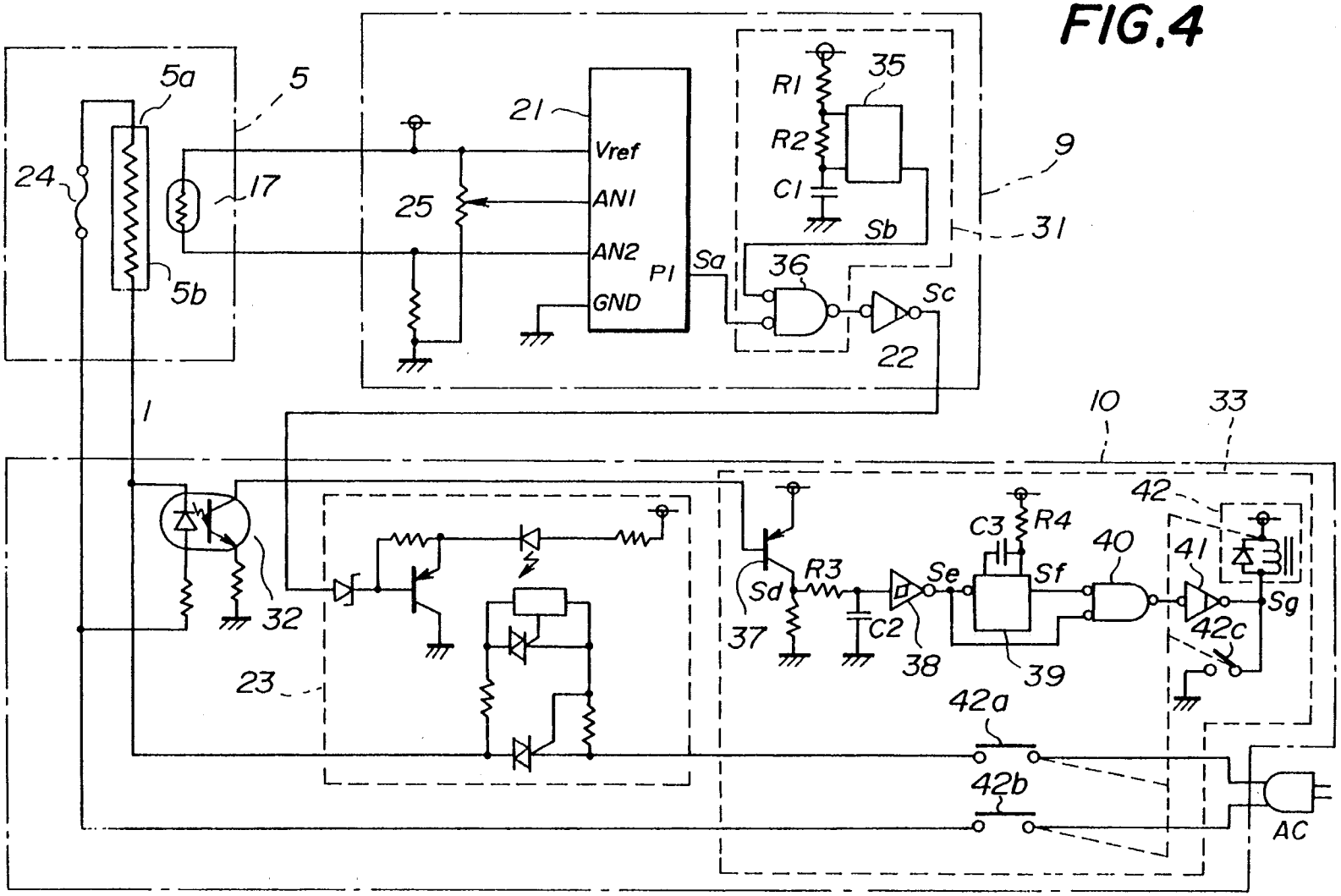
FIG. 4 is a diagram showing a first embodiment of a fixing unit protection apparatus according to the present invention.

A description will be given of a first embodiment of a fixing unit protection apparatus according to the present invention, with reference to FIGS. 4 through 6. In FIG. 4, those parts which are the same as those corresponding parts in FIG. 2 are designated by the same reference numerals, and a description thereof will be omitted.

In the first embodiment of the present invention shown in FIG. 4, in order to effectively detect a malfunction occurring in a fixing temperature control circuit, a power cut signal generating circuit 31 is provided in the engine board 9 for generating a power cut signal which allows electrical current applied to the heater 5*b* to be forcedly cut off for a short time at a predetermined time interval. Also, in order to effectively detect a malfunction occurring in the fixing temperature control circuit, there are provided a photocoupler 32 and a current cutting circuit 33 in the power supply unit 10, the photocoupler 32 being connected to a line through which current is supplied from a power supply to the heater 5*b*, the current cutting circuit 33 having an input line connected to the photocoupler 32 and an output line connected to contact points 42*a*, 42*b* through which current is supplied from the power supply to the heater 5*b*. The photocoupler 32 generates a signal indicative of whether the heater 5*b* is in an "ON" state or in an "OFF" state thereof. The current cutting circuit 33 opens the contact points 42*a*, 42*b* to cut off the application of current to the heater 5*b* when it is determined on the basis of an output signal of the photocoupler 32 that the ON state of the heater 5*b* continues for a time period which is longer than a predetermined time period "t", which will be described below.

Figure 5:
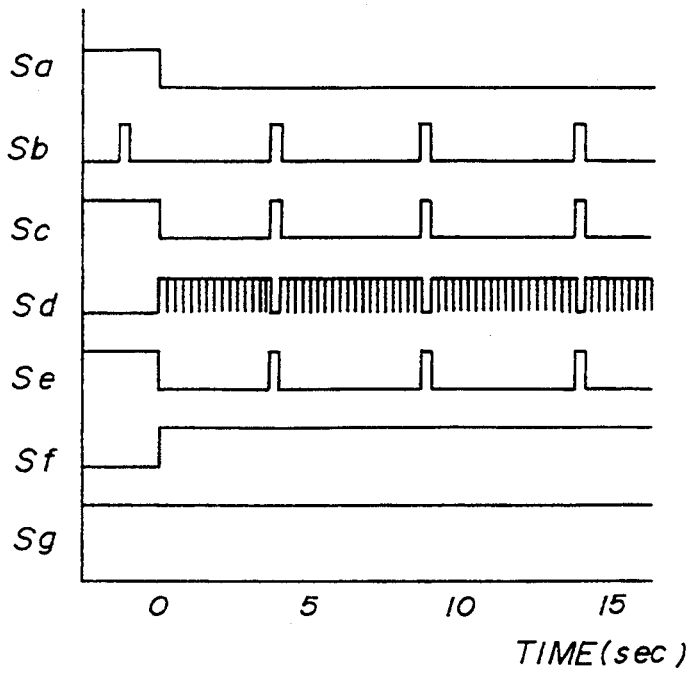
FIGS. 5 and 6 are timing charts for explaining the operations of the fixing unit protection apparatus shown in FIG. 4.
Figure 6:
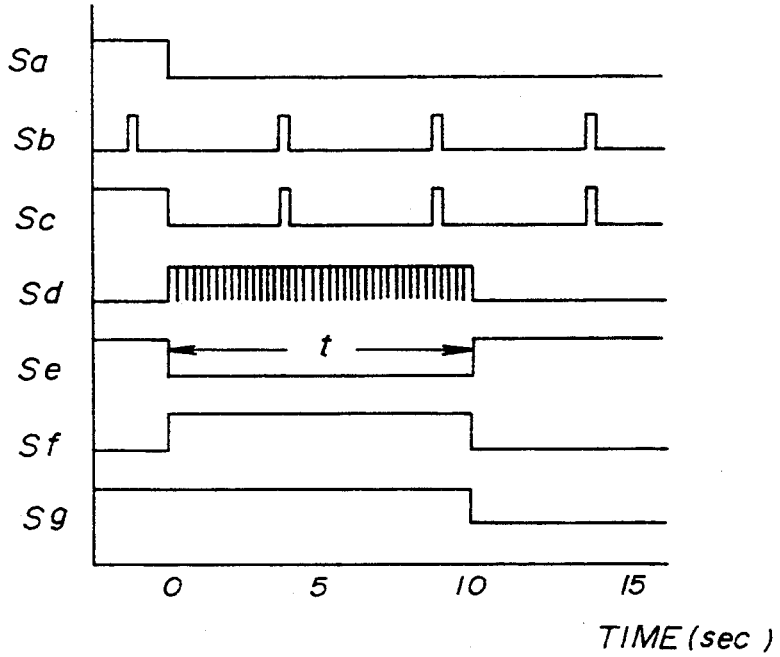

FIGS. 5 and 6 are timing charts of several signals for explaining the operations of the fixing unit protection apparatus. A "heater ON" signal S*a* is generated from an output port P1 of the microcomputer 21 in the engine board 9. In the power cut signal generating circuit 31 in the engine board 9, a timer circuit including a timer IC 35 (for example, NE555), resistors R1, R2 and a capacitor C1 are is provided for generating a power cut signal S*b* which instructs the fixing unit protection apparatus to forcedly switch OFF application of current to the heater 5*b*. The power cut signal S*b* is superimposed over the "heater ON" signal S*a* by a NAND gate 36, and a "heater ON" signal S*c* in which several signal portions of "heater OFF" state of the signal S*b* are included is outputted to the power supply unit 10. A time period and duty cycle of the signal portions of "heater OFF" state in the "heater ON" signal S*c* are determined depending on the resistance of the resistors R1, R2 and the capacitance of the capacitor C1.

In the present embodiment, the power cut signal S*b* as shown in FIG. 5 is changed to "HIGH" state corresponding to the "heater OFF" state for 0.5 seconds at time intervals of 5 seconds. The rate of the "heater OFF" period (0.5 seconds) to the time period (5 seconds) of the signal S*c* is equivalent to a duty factor of 10%. As shown in FIG. 5, while the signal S*a* is continuously in "LOW" state, the signal S*c* is periodically changed from "LOW" state to "HIGH" state, which accords with changes of the power cut signal S*b*, the rate of the changes of the signal S*c* equivalent to 10% duty factor (0.5 sec for 5 sec).

In the meantime, the power supply unit 10 is monitoring an "ON" state and an "OFF" state of the heater 5*b* by checking a heater current I which is applied to the heater 5*b*, through the photocoupler 32 in the power supply unit 10 and a transistor 37 in the current cutting circuit 33, and the heater current is taken out as a pulsating signal S*d* which is shown in FIG. 5. This monitoring circuit part for monitoring the ON/OFF state of the heater 5*b* according to the present invention is not limited to this embodiment, and modifications may be made. For example, a current monitoring circuit having a current transformer and a rectifier, or a photodetector for detecting directly generation of light from the heater 5*b* may be used instead.

The pulsating signal S*d* from the transistor 37 is subjected to a waveform shaping when it passed through an integration circuit including a capacitor C2 and a resistor R3, and passed through a Schmitt trigger circuit 38. And, a monitor signal S*e* which corresponds to the "heater ON" signal S*c* is supplied from the Schmitt trigger circuit 38 to a retriggerable monostable multivibrator 39 which is operated in accordance with a time constant which is determined depending on a capacitor C3 and a resistor R4. This monostable multivibrator checks whether the time period for which the heater 5*b* is continuously in the ON state exceeds a predetermined time-out period. The above mentioned time period "t" corresponds to this time-out period which is determined depending on the capacitance of the capacitor C3 and the resistance of the resistor R4, and the time period "t" in the present embodiment is set to, for example, 10 seconds.

If the fixing unit operates normally with no malfunction therein, the monitor signal S*e* is retriggering periodically, or changed from "LOW" state" to "HIGH" state for 0.5 seconds at time intervals of 5 seconds, as shown in FIG. 5. A time-out signal S*f* outputted by the multivibrator 39 is continuously in the "HIGH" state. The signal outputted by the NAND gate 40 remains unchanged and is continuously in the "HIGH" state, and the relay operation signal S*g* outputted by the relay driver 41 is also continuously in the "HIGH" state.

However, if a malfunction occurs in the SSR 23 and the heater 5*b* is continuously in the ON state for a long time period, which is longer than a predetermined time period, the monitor signal S*e* is not periodically retriggered and is continuously in the LOW" state for an excessively long time period, as shown in FIG. 6. The time-out signal S*f* outputted by the monostable multivibrator 39 is changed to the "LOW" state after 10 seconds have elapsed from a time when it has been changed to the "HIGH" state and application of current to the heater 5*b* has been started. The signal outputted by the NAND gate 40 is changed to the "LOW" state, and the relay operation signal S*g* is also changed to the "LOW" state, as shown in FIG. 6. The relay 42, including a pair of normally closed contact points 42*a*, 42*b* and a normally opened contact point 42*c*, is then operated by the relay operation signal Sg changed to the "LOW" state, so that the contact points 42*a*, 42*b* and the application of current to the heater 5*b* is cut off. And, the contact point 42*c* is closed so that the operation of the relay 42 is retained continuously. Thus, no current is supplied to the heater 5*b* until the current cutting is thus performed and the power switch is again turned ON. Therefore, according to the present invention, it is possible to protect safely the fixing unit in the laser printer against failure, in a case in which a malfunction takes place in the fixing temperature control circuit but the fixing unit is operating normally.

The present invention is not limited to the above described embodiment, and modifications may be made without departing from the scope of the present invention. For example, a monitoring circuit using a microcomputer may be used instead of the above mentioned monostable multivibrator 39, and a solid-state relay (SSR) may used instead of the above mentioned relay 42. Also, the "heater OFF" duration, the "heater OFF" time period, and the predetermined time period "t" may be selected to an arbitrary value, only if the above described protection capability of the fixing unit protection apparatus can be achieved.

In the first embodiment, the time period "t" is preset to 10 seconds, and the heater is prevented from being overheated due to a malfunction occurring in the fixing temperature control circuit such that the time period does not exceed 10 seconds, regardless of the temperature of the fixing unit. And, it is possible to detect a malfunction in the fixing temperature control circuit without damaging the fixing unit. If necessary, the time period "t" can be preset to a smaller value.

Figure 7:
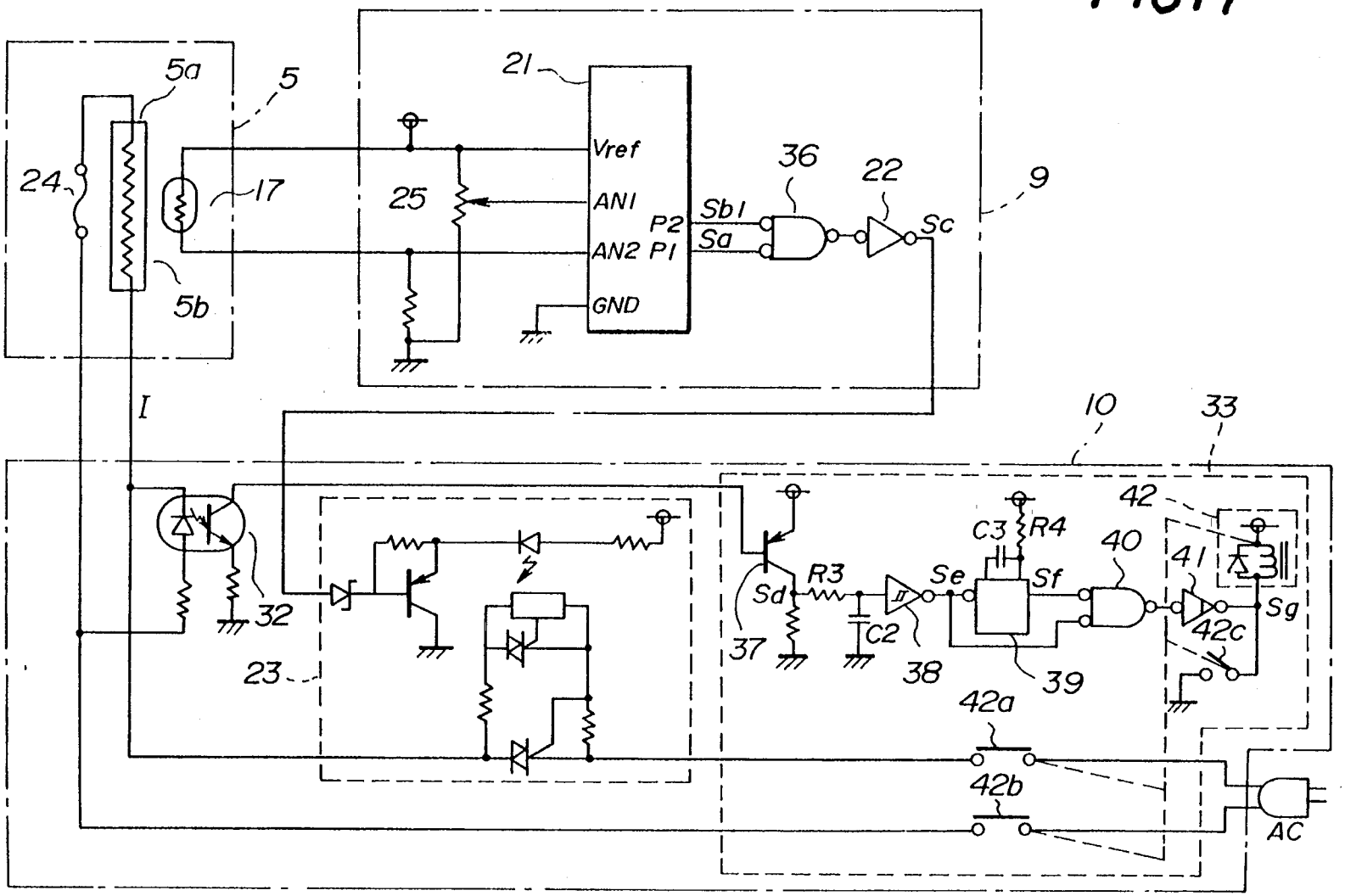
FIG. 7 is a diagram showing a second embodiment of the present invention.

FIG. 7 shows a second embodiment of the present invention. In FIG. 7, those parts which are the same as those corresponding parts in FIG. 4 are designated by the same reference numerals, and a description thereof will be omitted. In this second embodiment of the fixing unit protection apparatus, the timer circuit including the timer IC 35, the resistors R1, R2 and the capacitor C1 as shown in FIG. 4 is omitted, and the microcomputer 21 uses its timer function which is equivalent to the function of the above timer circuit. A power cut signal S*b*1 corresponding to the power cut signal S*b* shown in FIG. 4, is generated from an output port P2 of the microcomputer 21. Thus, the manufacturing cost of the apparatus in the second embodiment can be reduced from the manufacturing cost of the apparatus in the first embodiment requiring the timer circuit.

In a case in which a malfunction or crash takes place in the microcomputer 21, the microcomputer 21 does not generate the power cut signal S*b*1, and the "heater ON" signal S*c* becomes unchanged. If the signal S*c* becomes unchanged when the heater 5*b* is in the "ON" state, the current cutting circuit 33 in the power supply unit 10 is operative for protecting the fixing unit 5 against overheating or other damage. In the third embodiment, it is possible to eliminate a risk when the microcomputer is used.

In the second embodiment, the "heater ON" signal S*a* and the power cut signal Sb1 are generated respectively from the output ports P1 and P2 of the microcomputer 21, and these signals are supplied to the drive element 22 through the NAND gate 36, and the superimposed "heater ON" signal S*c* which is similar to the signal S*c* shown in FIG. 4 is outputted by the drive element 22. However, several modifications of this embodiment may be made without departing from the scope of the invention. For example, the "heater ON" signal S*a* and the power cut signal S*b*1 are processed by the microcomputer 21 into a composite signal such as the superimposed signal S*c*, and this composite signal is outputted from one of the output ports P1, P2 of the microcomputer 21 to the drive element 22, and then a "heater ON" signal S*c* is outputted by the drive element 22. In such a modified embodiment, only one of the two ports of the microcomputer 21 is used and the other one is unused.

Figure 8:
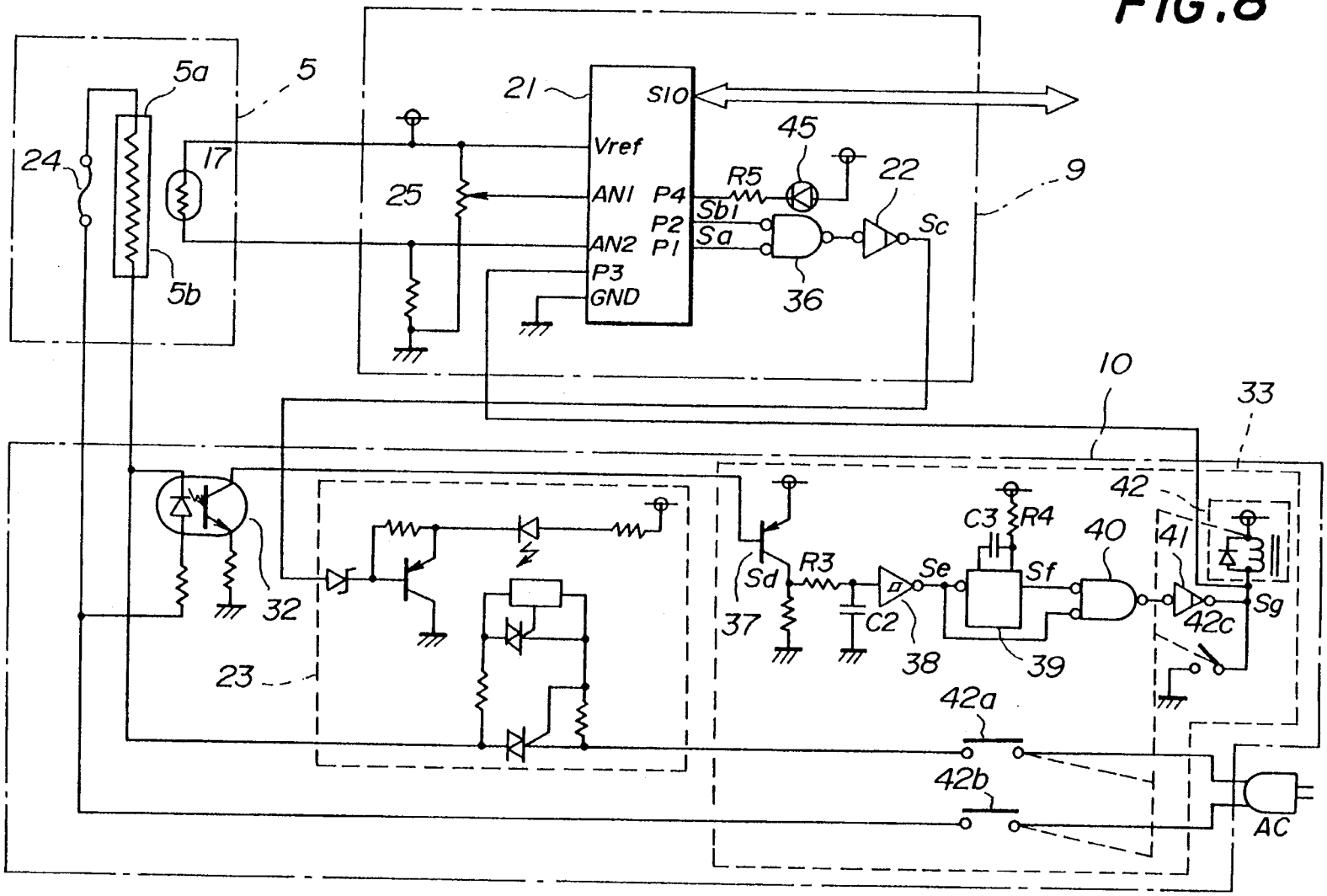
FIG. 8 is a diagram showing a third embodiment of the present invention.

FIG. 8 shows a third embodiment of the present invention. In FIG. 8, those parts which are the same as those corresponding parts in FIG. 4 are designated by the same reference numerals, and a description thereof will be omitted. In the third embodiment, the fixing unit protection apparatus includes means for detecting an operating condition of the relay 42 in the power supply unit 10. This detecting means can be formed by a suitable means. For example, the microcomputer 21 includes an input port P3 which is connected to an input terminal of the relay 42 at a coil thereof, and the microcomputer 21 is capable of detecting an "ON" state or "OFF" state of the relay 42 from the relay operation signal S*g* supplied from the relay driver 41 to the relay 42. The fixing unit protection apparatus also includes a warning means for giving to an operator a warning of a malfunction occurring in the fixing temperature control circuit. The information given by the warning means includes the location of the malfunction in the fixing temperature control circuit, that is, the malfunction occurs in the engine board 9, or in the power supply unit 10, or elsewhere (but, not in the fixing unit), and such a note that a repair or part exchange is required. In order to form the warning means, the microcomputer 21 includes an output port P4, and a light emitting diode (LED) 45 is connected to this output port P4 of the microcomputer 21 through a resistor R5. When the relay operation signal S*g* is changed from "HIGH" state to "LOW" state as shown in FIG. 6 and the microcomputer 21 detects an "OFF" state of the relay 42, the microcomputer 21 allows the LED 45 to be switched ON so that a warning of the malfunction is given to an operator. This malfunction is located in the fixing temperature control circuit not in the fixing unit 5. In another modified embodiment, a warning of the malfunction may be given to an external device (not shown) including a controller, a host computer (for example, a wordprocessor) or another indicating device via a serial transmission path between the microcomputer and the external device.

In the foregoing description, the laser printer to which the fixing unit protection apparatus according to the present invention is applied is dealt with, but it should be noted that the present invention is applicable to other light-source printers including a LED printer, a liquid-crystal shutter printer or the like, as well as other image forming systems including a photocopier, a facsimile machine or the like.

Further, the present invention is not limited to the above described embodiments, and various variations and modifications may be made without departing from the scope of the present invention.

What is claimed is:

1. An apparatus for protecting a fixing unit in an image forming system against damage, comprising:

first detection means for detecting a fixing temperature of a fixing roller in the fixing unit at which toner is fixed on a copy sheet, said fixing roller being heated by a heater provided within the fixing roller;

current control means for switching ON and OFF application of current to said heater in response to said fixing temperature detected by said first detection means, so as to prevent the fixing temperature of the fixing roller from becoming excessively high;

signal generating means for generating a signal which instructs said current control means to periodically switch ON and OFF the application of current to said heater, in which the application of current to said heater is switched OFF for a short time at a first time interval which is predetermined and;

second detection means for detecting an ON state of said heater in which the current is continuously applied to said heater, and for detecting an OFF state of said heater in which no current is applied to said heater; and current cutting means for cutting off the application of the current to said heater when said ON state of said heater detected by said second detection means continues for a second time interval which is longer than said predetermined time interval of said signal generating means.

2. The apparatus as claimed in claim 1, wherein said current control means includes a microcomputer having a timer function and said signal generating means is formed by said microcomputer in common.

3. The apparatus as claimed in claim 1, further comprising warning means for giving a warning of a malfunction to an operator, when the ON state of the heater detected by the second detection means continues for more than said second time interval, said warning given by said warning means including information about a location of said malfunction in said current control means.

4. The apparatus as claimed in claim 3, wherein said warning means includes a light emitting diode which is switched ON by a microcomputer when the ON state of the heater detected by the second detection means continues for more than said second time interval and a malfunction has been detected in the current control means.

5. The apparatus as claimed in claim 2, further comprising warning means for giving a warning of a malfunction to an operator, when the ON state of the heater detected by the second detection means continues for more than said second time interval, said warning given by said warning means including information about a location of said malfunction in said current control means.

6. The apparatus as claimed in claim 5, wherein said warning means includes a light emitting diode which is switched ON by a microcomputer when the ON state of the heater detected by the second detection means continues for more than said second time interval and a malfunction has been detected in the current control means.

7. The apparatus as claimed in claim 1, wherein said signal generating means includes a timer device which is connected to a resistor and a capacitor, said first predetermined time interval being predetermined depending on a resistance of said resistor and a capacitance of said capacitor.

8. The apparatus as claimed in claim 1, wherein said current cutting means includes a monostable multivibrator which is connected to a resistor and a capacitor, said second time interval being predetermined depending on a resistance of said resistor and a capacitance of said capacitor.

9. The apparatus as claimed in claim 1, wherein said second detection means includes a photocoupler which is connected to a line through which current from a power supply is supplied to said heater, said photocoupler outputting to said current cutting means a signal indicative of whether said heater is in the ON state or in the OFF state.

10. The apparatus as claimed in claim 1, wherein said current cutting means includes a relay having a contact point provided in a line through which current is supplied from a power supplied to said heater, said current cutting means inputting to said relay a signal indicative of whether or not the ON state of the heater detected by the second detection means continues for more than said second time interval, so that said contact point is opened by said relay in response to said signal inputted to said relay.

11. The apparatus as claimed in claim 1, wherein said current cutting means includes a monostable multivibrator which is connected to a resistor and a capacitor, said second time interval being predetermined depending on a resistance of said resistor and a capacitance of said capacitor, said current cutting means further including a relay having a contact point provided in a line through which current is supplied from a power supply to said heater, a signal being supplied from said monostable multivibrator to said relay, which is indicative of whether or not the ON state of the heater detected by the second detection means continues for more than said second time interval, so that said contact point is opened and closed by said relay in response to said signal supplied to said relay.

12. An apparatus for protecting a fixing unit in an image forming system against damage, comprising:

first detection means for detecting a fixing temperature of a fixing roller in the fixing unit at which toner is fixed on a copy sheet, said fixing roller being heated by a heater provided within the fixing roller;

current control means for switching ON and OFF application of current to said heater in response to said fixing temperature detected by said first detection means, so as to prevent the fixing temperature of the fixing roller from becoming excessively high;

signal generating means for generating a signal which instructs said current control means to periodically switch ON and OFF the application of current to said heater immediately after a power switch of the image forming system is turned on, in which the application of current to said heater is switched OFF for a short time at a first predetermined time interval;

second detection means for detecting an ON state of said heater in which the current is continuously applied to said heater, and for detecting an OFF state of said heater in which no current is applied to said heater; and current cutting means for cutting off the application of the current to said heater when said ON state of said heater detected by said second detection means continues for a second time interval which is longer than said first predetermined time interval of said signal generating means.

13. The apparatus as claimed in claim 12, wherein said current control means includes a microcomputer having a timer function and said signal generating means is formed by said microcomputer in common.

14. The apparatus as claimed in claim 12, further comprising warning means for giving a warning of a malfunction to an operator, when the ON state of the heater detected by the second detection means continues for more than said second time interval, said warning given by said warning means including information about a location of said malfunction in said current control means.

15. The apparatus as claimed in claim 14, wherein said warning means includes a light emitting diode which is switched ON by a microcomputer when the ON state of the heater detected by the second detection means continues for more than said second time interval and a malfunction has been detected in the current control means.

16. The apparatus as claimed in claim 12, wherein said signal generating means includes a timer device which is connected to a resistor and a capacitor, said first predetermined time interval being predetermined depending on a resistance of said resistor and a capacitance of said capacitor.

17. The apparatus as claimed in claim 12, wherein said current cutting means includes a monostable multivibrator which is connected to a resistor and a capacitor, said second time interval being predetermined depending on a resistance of said resistor and a capacitance of said capacitor.

18. The apparatus as claimed in claim 12, wherein said second detection means includes a photocoupler which is connected to a line through which current from a power supply is supplied to said heater, said photocoupler outputting to said current cutting means a signal indicative of whether said heater is in the ON state or in the OFF state.

19. The apparatus as claimed in claim 12, wherein said current cutting means includes a relay having a contact point provided in a line through which current is supplied from a power supplied to said heater, said current cutting means inputting to said relay a signal indicative of whether or not the ON state of the heater detected by the second detection means continues for more than said second time interval, so that said contact point is opened by said relay in response to said signal inputted to said relay.

20. The apparatus as claimed in claim 12, wherein said current cutting means includes a monostable multivibrator which is connected to a resistor and a capacitor, said second time interval being predetermined depending on a resistance of said resistor and a capacitance of said capacitor, said current cutting means further including a relay having a contact point provided in a line through which current is supplied from a power supply to said heater, a signal being supplied from said monostable multivibrator to said relay, which is indicative of whether or not the ON state of the heater detected by the second detection means continues for more than said second time interval, so that said contact point is opened and closed by said relay in response to said signal supplied to said relay.

21. A method for protecting a fixing unit in an image forming system against damage, comprising the steps of:

detecting a fixing temperature of a fixing roller in the fixing unit at which toner is fixed on a copy sheet, said fixing roller being heated by a heater provided within the fixing roller;

switching ON and OFF application of current to said heater in response to the fixing temperature detected in said detecting step so as to prevent the fixing temperature from being excessively high;

generating a control signal to periodically switch ON and OFF the application of current to said heater to thereby cause the heater to be switched OFF for a short time after being ON for a first predetermined time interval;

detecting an ON state of said heater in which the current is continuously applied to said heater;

detecting an OFF state of said heater in which no current is applied to said heater; and cutting off the application of current to said heater when said ON state of said heater continues for a time interval which is longer than said first predetermined time interval.

22. A system for protecting a fixing unit in an image forming system against damage, said fixing unit comprising a fixing roller heated with an electrically driven heater supplied with electrical power from a power source, and said system comprising:

a first detector unit detecting a fixing temperature of said fixing roller at which toner is fixed on a copy sheet;

a switching circuit coupled with first detector and said power source to selectively apply electrical current from said source to said heater in response to the fixing temperature detected by said first detector unit;

a control signal generator generating a control signal which alternates between a first state that has a relatively short time duration and a second state that has a relatively long time duration, said control signal being applied to said switching circuit to command the switching circuit not to apply current to the heater during times corresponding to said relatively short time duration but to apply current to the heater during times corresponding to said relatively long time duration;

a second detector unit detecting the duration of time during which current is being supplied to the heater without interruption after each of said times corresponding to said relatively short time duration; and a current cut-off circuit coupled to said second detecting unit to cut off the application of current to the heater if the duration of time detected by the second detecting unit exceeds a time longer than said relatively long time duration.

* * * * *